US010337182B1

(12) United States Patent
Bender

(10) Patent No.: US 10,337,182 B1
(45) Date of Patent: Jul. 2, 2019

(54) TOILET SPLASH GUARD SYSTEMS

(71) Applicant: Duane R. Bender, Billings, MT (US)

(72) Inventor: Duane R. Bender, Billings, MT (US)

( * ) Notice: Subject to any disclaimer, the term of this patent is extended or adjusted under 35 U.S.C. 154(b) by 0 days.

(21) Appl. No.: 15/669,668

(22) Filed: Aug. 4, 2017

(51) Int. Cl.
*E03D 9/00* (2006.01)
*A47K 13/24* (2006.01)

(52) U.S. Cl.
CPC ..... *E03D 9/00* (2013.01); *A47K 13/24* (2013.01)

(58) Field of Classification Search
CPC ..... E03D 9/00
USPC ..... 4/300.3, DIG. 5
See application file for complete search history.

(56) References Cited

U.S. PATENT DOCUMENTS

| | | | | |
|---|---|---|---|---|
| 3,914,803 | A * | 10/1975 | Gregovski | A47K 13/24 4/300.3 |
| 5,564,135 | A | 10/1996 | Jones et al. | |
| 5,815,851 | A | 10/1998 | Perry | |
| 7,178,177 | B1 | 2/2007 | Valencia | |
| 7,412,732 | B1 | 8/2008 | Leonard | |
| 7,461,411 | B2 | 12/2008 | Wolf | |
| 7,921,478 | B1 | 4/2011 | Vanini | |
| 7,921,479 | B2 * | 4/2011 | Hunter | C11D 3/48 4/222 |
| 2009/0320198 | A1 | 12/2009 | Yefremov | |
| 2016/0369488 | A1 * | 12/2016 | Todd, IV | E03D 9/00 |

* cited by examiner

*Primary Examiner* — Lauren A Crane

(57) ABSTRACT

Toilet splash guard systems for preventing splashing of fluids from a toilet bowl to a surrounding floor area. The systems can be used with any common or pre-existing toilet seats, or to replace said toilet seats. Splash guards are disposed on a toilet seat such that a toilet bowl is disposed between panels of the splash guards. The panels capture the splashing fluids from the toilet bowl, thereby preventing the fluids from contaminating the floor area near the toilet.

3 Claims, 6 Drawing Sheets

TOILET SPLASH GUARD SYSTEMS

FIELD OF THE INVENTION

The present invention relates to a hygienic accessory for toilets, in particular, to a splash shield for toilet seats.

BACKGROUND OF THE INVENTION

Due to the nature of bacteria, maintaining restroom cleanliness and sanitation is important for the health of a person and the general public. When germs from a dirty restroom infect a person, it becomes very likely that the person will sicken others. One of the main causes of unsanitary conditions, particularly associated with men and boys, is the problem of splashing.

Conventional toilets typically include a toilet bowl, seat, and cover. When a male uses a conventional toilet to urinate, the male is likely standing, and the seat and cover are typically raised to provide direct access to the toilet bowl. Unfortunately, this position can lead to the inadvertent back splashing of the urine, which causes problems, such as unpleasant urine odor, stains, and residues on the toilet or near the toilet area, in particular, on the floor. This problem is particularly severe when the toilet is being used by either a large number of individuals or individuals who are elderly or infirm or being toilet-trained. For example, splashes outside the toilet bowl can be expected when a young child is being toilet trained. Persons who are impaired or disabled may also find it difficult to use a conventional toilet in the standing position without causing undesired splashing.

Existing solutions to mitigate backsplash include installing a splash guard on the toilet so provide covering to a portion of the toilet. The splash guard may be removable or permanently attached. As used herein, removable splash guards are removed in between uses or a period of uses, whereas permanent splash guards are attached to the toilet for a period of time and continuously used. Removable splash guards, such as those described in U.S. Pat. Nos. 7,461,411 and 7,178,177, are disadvantageous in that they require time to install prior to use, and storage during non-use, which can contaminate the storage area. For instance, a toddler who needs to urinate and has difficulty controlling his bladder may not be able to wait as the splash guard is being installed, and therefore would soil his clothing. Fixed splash guards, such as those described in U.S. Pat. Nos. 5,564,135, 7,412,732, and US20090320198, may be collapsible for convenience of storage on the toilet. However, their disadvantages include difficultly in cleaning, in particular, the collapsible pleats; complex moving parts, which are inherently more expensive to manufacture and harder to install; and storage between the toilet seat and rim or lid, which can lead to destruction of the guard due to a person sitting on the seat or lid and applying a compression force on the guard.

While U.S. Pat. No. 5,815,851 of Perry teaches a urinal splash shield that is flipped up for use and down for nonuse, the constant flipping motion can wear out the shield material. Furthermore, when a user sits on the toilet, the user's legs can inadvertently touch the contaminated shield surface. As another example, U.S. Pat. No. 7,921,478 of Vanini teaches a pivotal splash guard that can pivot 180 degrees from an operative, raised position down to tuck underneath the front end of the toilet bowl at a stored, lowered position. Again, when a user sits on the toilet, the user's legs can inadvertently touch the shield surface.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

It is an objective of the present invention to provide a toilet splash guard system for preventing splashing of fluids from a toilet bowl to a surrounding floor area. The systems described herein may be used with any common or pre-existing toilet seats, or to replace said toilet seats.

According to one embodiment, the toilet splash guard system may comprise a first splash guard comprising a first panel mounted to a first panel brace, a second splash guard comprising a second panel mounted to a second panel brace, a first seat brace having a first seat brace first end perpendicularly attached to the first panel brace and a first seat brace second end perpendicularly attached to the second panel brace such that the first and second panels are perpendicular to the first seat brace, a first seat connector for mounting the first seat brace to a toilet seat, a second seat brace having a second seat brace first end perpendicularly attached to the first panel brace and a second seat brace second end perpendicularly attached to the second panel brace such that the second seat brace is perpendicular to the first and second panel braces and parallel to the first seat brace, and a second seat connector for mounting the second seat brace to the toilet seat.

According to another embodiment, the toilet splash guard system may comprise a toilet seat having a first circumferential side edge and an opposing second circumferential side edge, a first splash guard disposed on the first circumferential side edge of the toilet seat and comprising at least one support arm extending from the first circumferential side edge and a first panel angularly mounted to the at least one support arm such that the first panel projects away from an underside surface of the toilet seat, and a second splash guard disposed on the second circumferential side edge of the toilet seat and comprising at least one support arm extending from the second circumferential side edge and a second panel angularly mounted to the at least one support arm such that the second panel projects away from the underside surface of the toilet seat. In some embodiments, a proximal end of the toilet seat may be mounted to a toilet bowl rim such that the toilet bowl is disposed between the first splash guard and the second splash guard.

One of the unique and inventive technical features of the present invention is the panels positioned exterior to and on opposing sides of the toilet bowl. Without wishing to limit the invention to any theory or mechanism, it is believed that the technical feature of the present invention advantageously provides for a simple splash guard system that can effectively prevent fluids from splashing to the floor area near the toilet without inadvertently making contact with the user, thus improving the sanitation and cleanliness of a restroom. None of the presently known prior references or work has the unique inventive technical feature of the present invention.

BRIEF DESCRIPTION OF THE DRAWINGS

The features and advantages of the present invention will become apparent from a consideration of the following detailed description presented in connection with the accompanying drawings in which.

DESCRIPTION OF PREFERRED EMBODIMENTS

Figure 1:
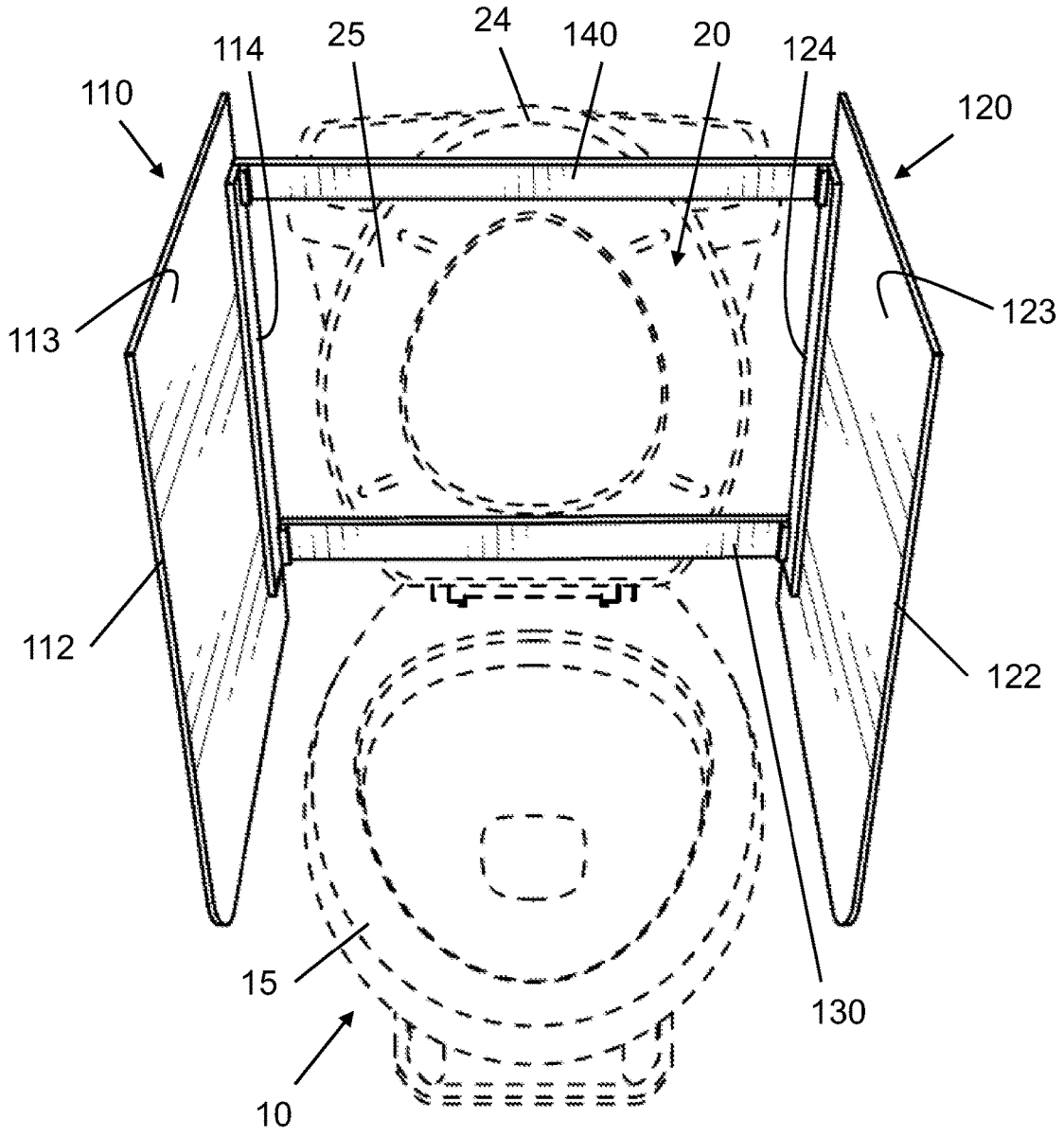
FIG. 1 shows an embodiment of a toilet splash guard of the present invention in a raised position.

Following is a list of elements corresponding to a particular element referred to herein:

10 toilet bowl
15 toilet bowl rim
20 toilet seat
22 proximal end of toilet seat
24 distal end of toilet seat
25 underside surface of toilet seat
27 exterior circumferential edge
28*a* first side of toilet seat
28*b* second side of toilet seat
100 toilet splash guard system
110 first splash guard
112 first panel
113 interior surface of first panel
114 first panel brace
120 second splash guard
122 second panel
123 interior surface of second panel
124 second panel brace
130 first seat brace
132 first seat brace first end
134 first seat brace second end
136 first seat connector
140 second seat brace
142 second seat brace first end
144 second seat brace second end
146 second seat connector
150 panel edge lip Referring now to FIG. 1-11, it is an objective of the present invention to provide a toilet splash guard system (100) for preventing splashing of fluids from a toilet bowl (10) to a surrounding floor area.

Figure 2:
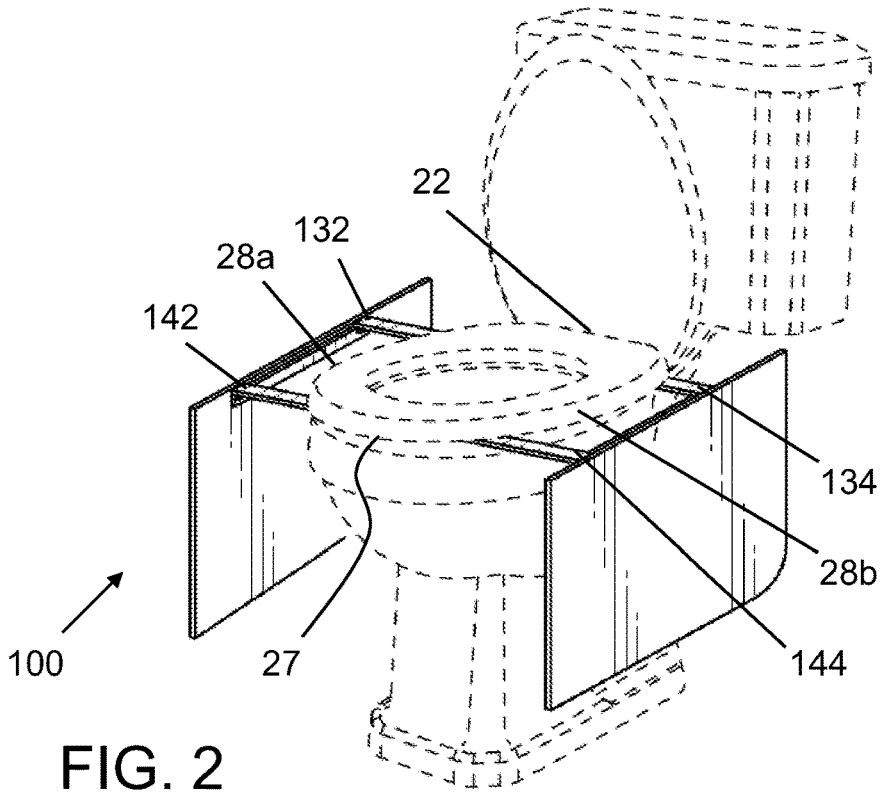
FIG. 2 shows an alternative embodiment of the toilet splash guard in a lowered position.

As shown in FIGS. 1-2, in one embodiment, the toilet splash guard system (100) may comprise a first splash guard (110) comprising a first panel (112) mounted to a first panel brace (114), a second splash guard comprising a second panel (122) mounted to a second panel brace (124), a first seat brace (130) having a first seat brace first end (132) perpendicularly attached to the first panel brace (114) and a first seat brace second end (134) perpendicularly attached to the second panel brace (124) such that the first and second panels (112,122) are perpendicular to the first seat brace (130), a first seat connector (136) for mounting the first seat brace (130) to a toilet seat (20), a second seat brace (140) having a second seat brace first end (142) perpendicularly attached to the first panel brace (114) and a second seat brace second end (144) perpendicularly attached to the second panel brace (124) such that the second seat brace (140) is perpendicular to the first and second panel braces (114,124) and parallel to the first seat brace (130), and a second seat connector (146) for mounting the second seat brace (140) to the toilet seat (20).

In some embodiments, the first seat brace (130) may be mounted near a proximal end (22) of the toilet seat via the first seat connector (136) such that the first seat brace (130) spans an underside surface (25) of the toilet seat. Further still, the first seat brace first end (132) and the first seat brace second end (134) may extend beyond an exterior circumferential edge (27) of the toilet seat.

In other embodiments, the second seat brace (140) may be mounted near a distal end (24) of the toilet seat via the second seat connector (146) such that the second seat brace (140) spans the underside surface (25) of the toilet seat. The second seat brace first end (142) and the second seat brace second end (144) may also extend beyond the exterior circumferential edge (27) of the toilet seat.

In preferred embodiments, the toilet bowl (10) is disposed between the first splash guard (110) and the second splash guard (120). As shown in FIG. 2, when the toilet seat (20) is in a first position over a toilet bowl rim (15), the first seat brace (130) and the second seat brace (140) may both be disposed between the toilet bowl rim (15) and the underside surface (25) of the toilet seat, and the first and second splash guards (110,120) are in a lowered position such the first and second panel braces (114,124) are horizontally oriented relative to the floor area. As shown in FIG. 1, when the toilet seat (20) is rotated from the first position to a second position up and away from the toilet bowl rim (15), the first and second splash guards (110,120) may also rotate to an upright position such that the first and second panel braces (114,124) are vertically oriented relative to the floor area. Preferably, the first and second panels (112,122) extend forwardly and away from the underside surface (25) of the toilet seat.

In exemplary embodiments, during use of the toilet bowl (10) and the first and second splash guards (110,120) are in the upright position, the fluids splashing from the toilet bowl (10) may splash onto an interior surface (113, 123) of the first and second panels. For instance, when a user is in a standing position during urination, the back splash of fluids may be captured on the interior surface (113, 123) of the first and second panels. Further still, when a user flushes the toilet, the splashing of fluids may be captured on the interior surface (113, 123) of the first and second panels. As another example, when a user plunges the toilet, the splashing of fluids may also be captured on the interior surface (113, 123) of the first and second panels. Hence, the toilet splash guard system (100) is effective for preventing splashing of fluids from the toilet bowl (10) to the surrounding floor area.

Figure 4:
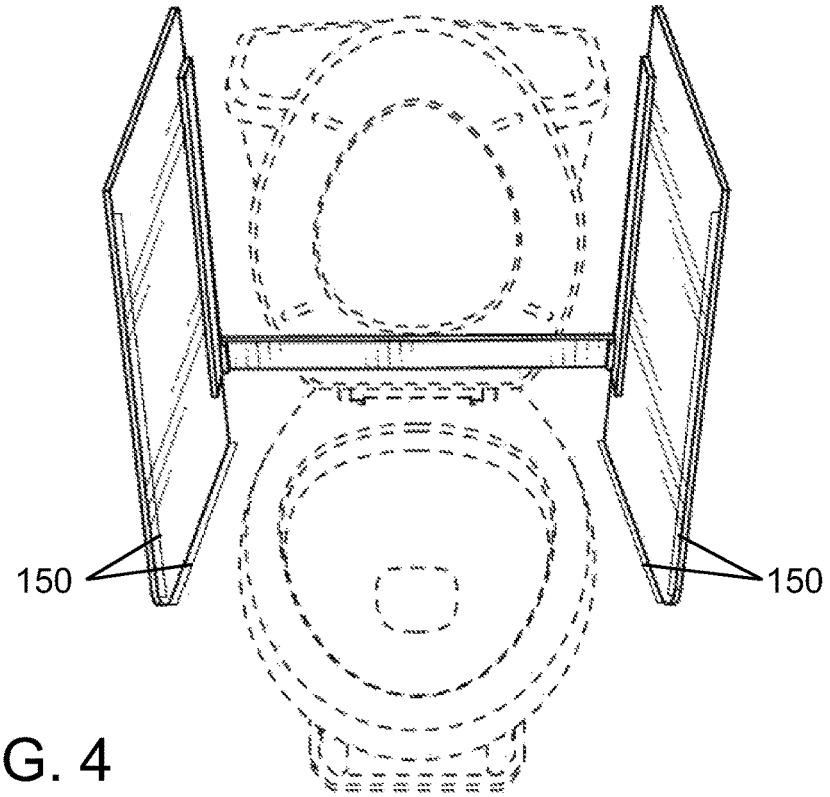
FIG. 4 shows an alternative embodiment of the toilet splash guard having a single seat support bar.
Figure 5:
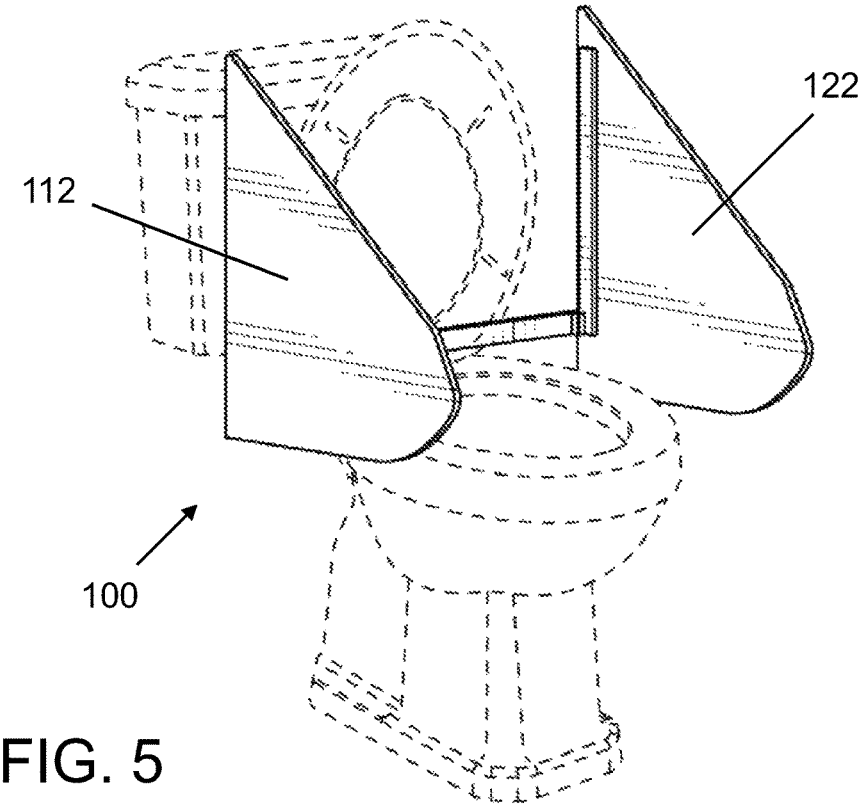
FIG. 5 shows an alternative embodiment of the splash guard panels.

Referring now to FIGS. 4 and 5, according to another embodiment, the toilet splash guard system (100) may comprise a first splash guard (110) comprising a first panel (112) mounted to a first panel brace (114), a second splash guard comprising a second panel (122) mounted to a second panel brace (124), a first seat brace (130) having a first seat brace first end (132) perpendicularly attached to the first panel brace (114) and a first seat brace second end (134)

perpendicularly attached to the second panel brace (124) such that the first and second panels (112,122) are perpendicular to the first seat brace (130), and a seat connector (136) for mounting the first seat brace (130) to a toilet seat (20). In this embodiment, the first seat brace (130) may be mounted near a proximal end (22) of the toilet seat via the seat connector (136) such that the first seat brace (130) spans an underside surface (25) of the toilet seat. Preferably, the first seat brace first end (132) and the first seat brace second end (134) extend beyond an exterior circumferential edge (27) of the toilet seat such that the toilet bowl (10) is disposed between the first splash guard (110) and the second splash guard (120). Thus, the system (100) may require at least one seat brace to adequately support the system when attached to the toilet seat.

Consistent with previous embodiments, when the toilet seat (20) is in a first position over a toilet bowl rim (15), the first seat brace (130) is disposed between the toilet bowl rim (15) and the underside surface (25) of the toilet seat, and the first and second splash guards (110,120) are in a lowered position such the first and second panel braces (114,124) are horizontally oriented relative to the floor area. When the toilet seat (20) is rotated from the first position to a second position up and away from the toilet bowl rim (15), the first and second splash guards (110,120) may also rotate to an upright position such that the first and second panel braces (114,124) are vertically oriented relative to the floor area. Preferably, the first and second panels (112,122) extend forwardly and away from the underside surface (25) of the toilet seat.

In some embodiments, the toilet splash guard system (100) may further comprise a second seat brace (140) having a second seat brace first end (142) perpendicularly attached to the first panel brace (114) and a second seat brace second end (144) perpendicularly attached to the second panel brace (124) such that the second seat brace (140) is perpendicular to the first and second panel brace (114,124) and parallel to the first seat brace (130). A second seat connector (146) may be used for mounting the second seat brace (140) to the toilet seat (20). For example, the second seat brace (140) may be mounted near a distal end (24) of the toilet seat via the second seat connector (146) such that the second seat brace (140) spans the underside surface (25) of the toilet seat, and the second seat brace first end (142) and the second seat brace second end (144) extend beyond the exterior circumferential edge (27) of the toilet seat.

In one embodiment, the first and second seat braces (130,140) may be flat, linear rigid bars. In another embodiment, the first and second panel braces (114,124) may flat, linear rigid bars. For instance, the seat braces and the panel braces may rectangular in shape. In some embodiments, the braces may be constructed from wood, metal, or a rigid plastic. Preferably, the braces are sufficiently strong to support the panels. In some embodiments, the braces have a length that is longer than the widest width of the toilet seat. For example, the braces may be at least about 12 inches, 15 inches or 18 inches in length. In preferred embodiments, the braces may have a length sufficient to allow for each end of the braces to extend at least about 2-4 inches from the exterior edge of the toilet seat, thereby placing the panels at a distance from the edge so as to not obstruct the user or abut the toilet bowl, yet close enough to capture the splashing fluids.

In other embodiments, the first and second panels (112, 122) may be flat and rectangular in shape. In alternative embodiments, as shown in FIG. 5, the first and second panels (112,122) may be triangular in shape. However, it is to be understood that the panels may be in any shape that provides sufficient surface area to capture the splashing fluids. In some embodiments, the panels may be a thin board constructed from wood or plastic. Preferably, the panels are relatively lightweight and rigid. In other embodiments, the surface of the panel may be water-resistant so as to not absorb the fluids, thereby preventing permanent soiling and odors from accumulating on the panels. In further embodiments, the surface of the panels may be textured or have grooves that can entrap the fluids and reduce dripping.

Figure 3:
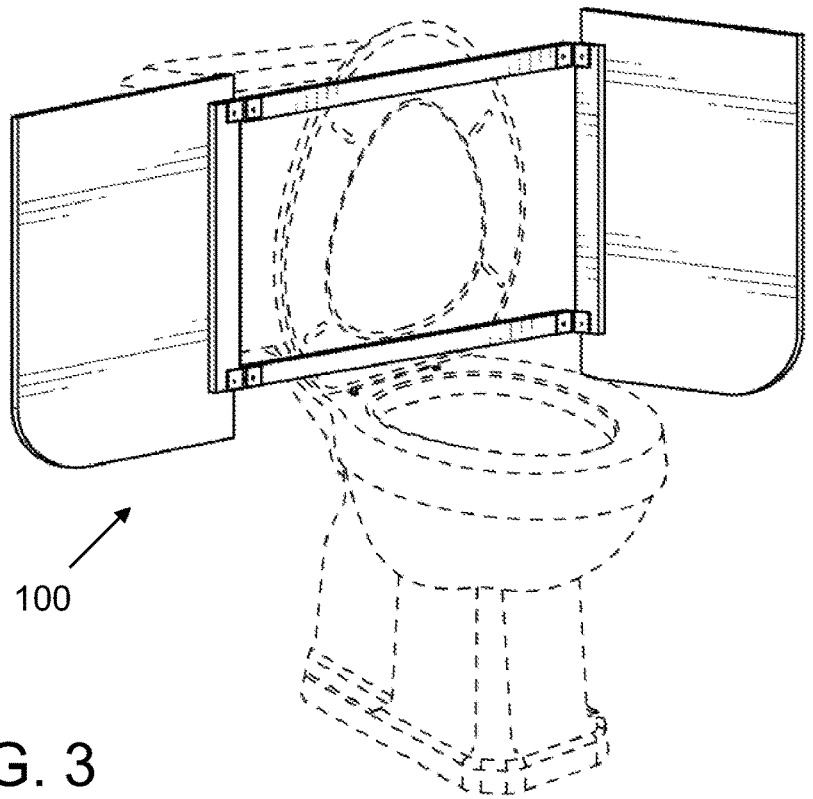
FIG. 3 shows an alternative embodiment of the toilet splash guard having pivotable splash guard panels.

According to some embodiments, the first and second splash guards (110,120) may be pivotably connected to the first and second seat braces (130,140). For instance, the panel braces may be connected to the seat braces via hinges. As shown in FIG. 3, the first and second splash guards (110,120) can pivot relative to the seat braces such that when in the upright position, the first and second panels (112,122) are capable of being moved towards the toilet bowl rim (15). For example, the panels may be rotated so as to be positioned closer to the rim in order to reduce splashing of the fluids to the surrounding floor area. The panels may also be pivoted outwardly and away from the toilet rim so as to facilitate cleaning of the interior panel surface, and to provide unobstructed access to the toilet bowl during cleaning. Further still, the panels may be pivoted to a closed configuration such that panels are overlapping each other and the entire system is flattened. This closed configuration is suitable for use during storage of the system or when the system is packaged.

Figure 6:
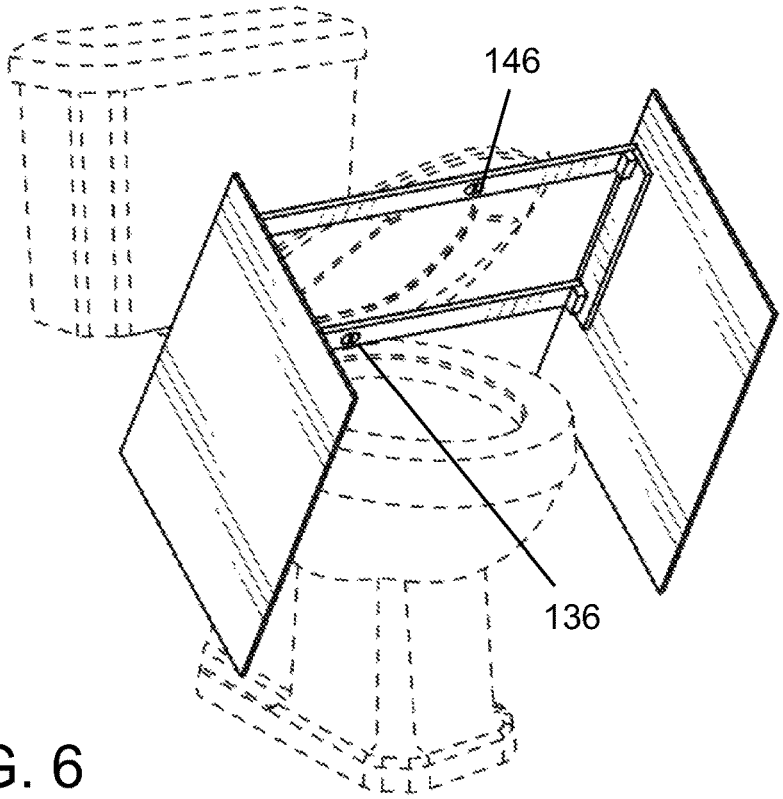
FIG. 6 shows an embodiment of attaching the toilet splash guard to a toilet seat.
Figure 7:
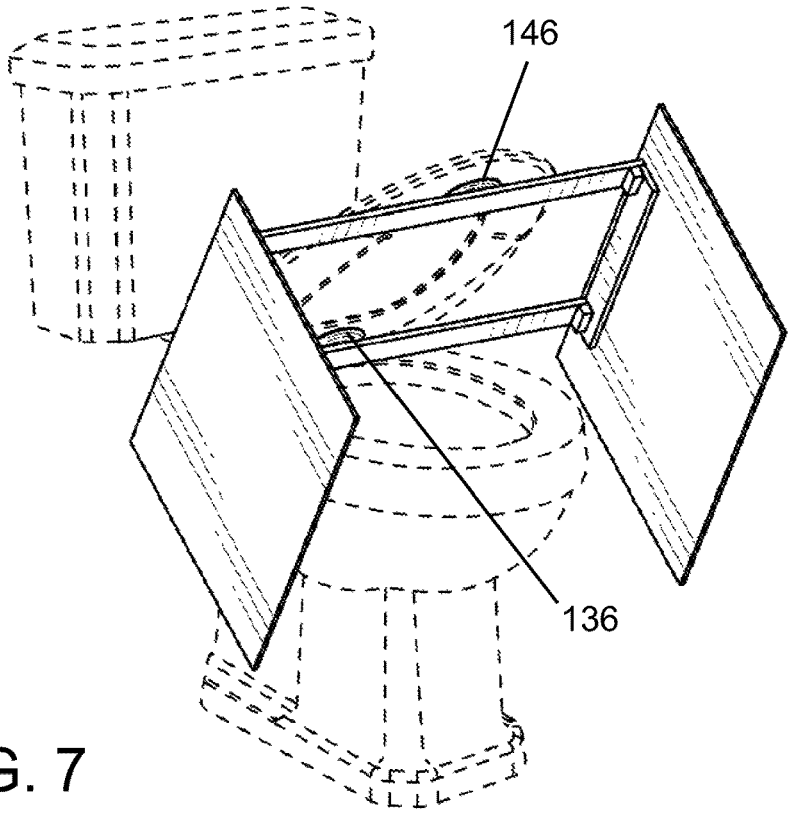
FIG. 7 shows an alternative embodiment of attaching the toilet splash guard to the toilet seat.

As shown in FIG. 6, the seat connectors (136,146) may be a screw. Preferably, the screw has a length that allows the seat braces to be mounted onto the underside surface of the toilet seat, yet does not protrude through the top side of the toilet seat. In some embodiments, the seat braces may be mounted onto the toilet seat using 1, 2, or 3 screws for each seat brace. In other embodiments, as shown in FIG. 7, the seat connectors may suctions cups that can suction onto the underside surface of the toilet seat. For instance, the seat braces may be mounted to the toilet using 1, 2, or 3 suctions for each brace. In further embodiments, the seat connectors may be an adhesive, such as an adhesive tape or glue.

In preferred embodiments, the seat braces are mounted to the underside surface near the distal and proximal ends of the toilet seat such that the seat braces are continually contacting the underside surface and do not cross the toilet seat aperture. Hence, this will enable the user to use the toilet seat in a seating position without the seat braces obstructing the toilet seat aperture.

Referring to FIG. 4, in one embodiment, each of the first and second panels (112,122) may have a lip (150) disposed along at least two adjacent panel edges. For example, the lip may be disposed along the edges of the panel that would be positioned closest to the floor area when the splash guards are in the lowered or upright position, such as a distal edge of the panel and the back edge of the panel. The lip is preferably biased towards the interior surface (113, 123), i.e. extending from the edges in the direction of the interior surface such that when the first and second splash guards (110,120) are in the lowered or upright position, the lip (150) is configured to capture the fluids that splash on the interior surfaces (113, 123), thereby preventing said fluids that would normally drip in a downward direction due to gravity from dripping onto the floor area. In some embodiments, the lip may be in the shape of a gutter, J-shaped, or L-shaped.

In the embodiments described above, the toilet splash guard system (100) may be installed onto any common or pre-existing toilet seat. However, in alternative embodiments, the system (100) may be fabricated with the toilet seat so as to form a unitary piece. Hence, the present invention provides a toilet splash guard system (100) that can replace the common or pre-existing toilet seats.

Referring now to FIGS. 8-11, another embodiment of the present invention may features a toilet splash guard system (100) comprising a toilet seat (20) having a first circumferential side edge (28*a*) and an opposing second circumferential side edge (28*b*), a first splash guard (110) disposed on the first circumferential side edge (28*a*) of the toilet seat and comprising at least one support arm (114) extending from the first circumferential side edge (28*a*) and a first panel (112) angularly mounted to the at least one support arm (114) such that the first panel (112) projects away from an underside surface (25) of the toilet seat, and a second splash guard (120) disposed on the second circumferential side edge (28*b*) of the toilet seat and comprising at least one support arm (124) extending from the second circumferential side edge (28*b*) and a second panel (122) angularly mounted to the at least one support arm (124) such that the second panel (121) projects away from the underside surface (25) of the toilet seat. In some embodiments, a proximal end (22) of the toilet seat may be mounted to a toilet bowl rim (15) such that the toilet bowl (10) is disposed between the first splash guard (110) and the second splash guard (120).

When the toilet seat (20) is in a first position over the toilet bowl rim (15), the first and second splash guards (110,120) may be in a lowered position such the support arms (114, 124) are horizontally oriented relative to the floor area. When the toilet seat (20) is rotated from the first position to a second position up and away from the toilet bowl rim (15), the first and second splash guards (110,120) may also to an upright position such that the support arms (114,124) are vertically oriented relative to the floor area and the first and second panels (112,122) extend forwardly and away from the underside surface (25) of the toilet seat. In preferred embodiments, during use of the toilet bowl (10) and the first and second splash guards (110,120) are in the upright position, the fluids splashing from the toilet bowl (10) are splashed onto an interior surface (113,123) of the first and second panels.

Figure 8:
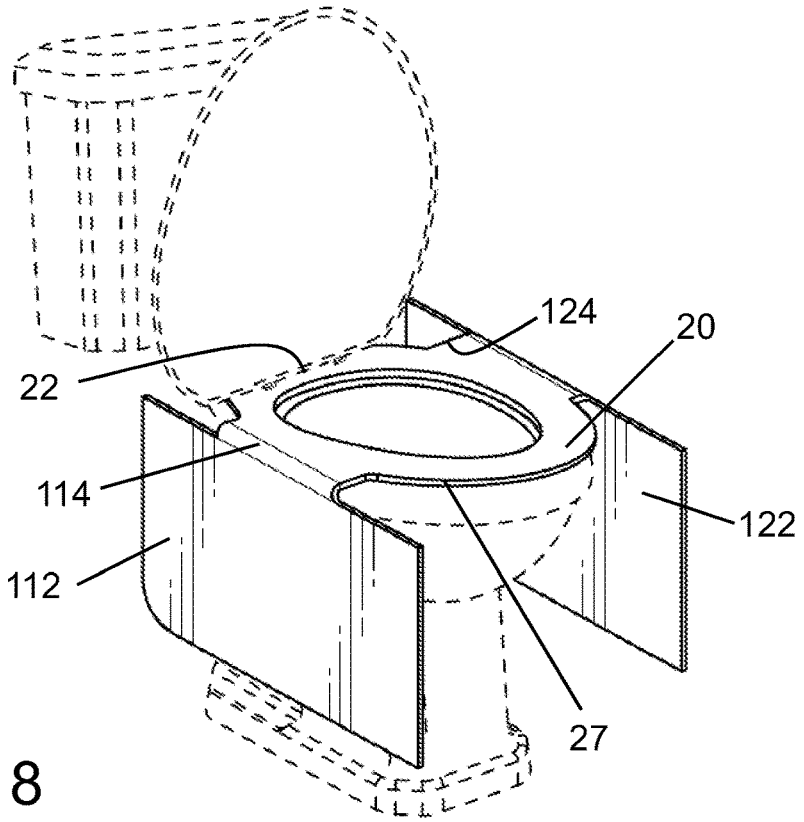
FIG. 8 shows an embodiment of the toilet seat having a toilet splash guard.
Figure 9:
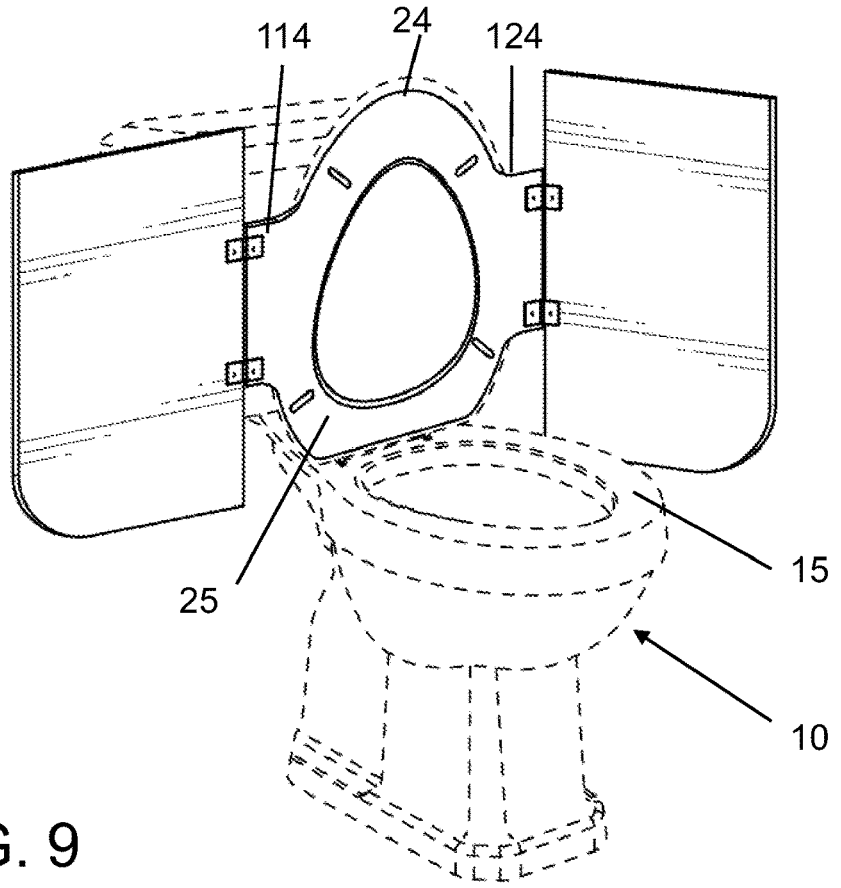
FIG. 9 shows an alternative embodiment of the toilet seat having a pivotable toilet splash guard panel.
Figure 10:
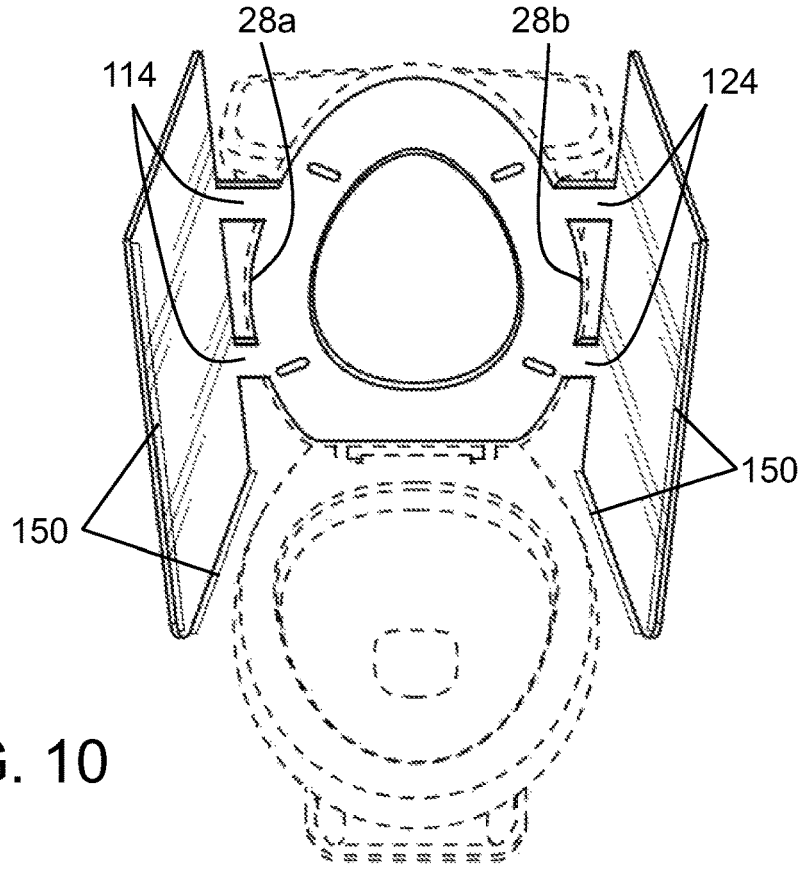
FIG. 10 shows an alternative embodiment of the toilet seat having a toilet splash guard.
Figure 11:
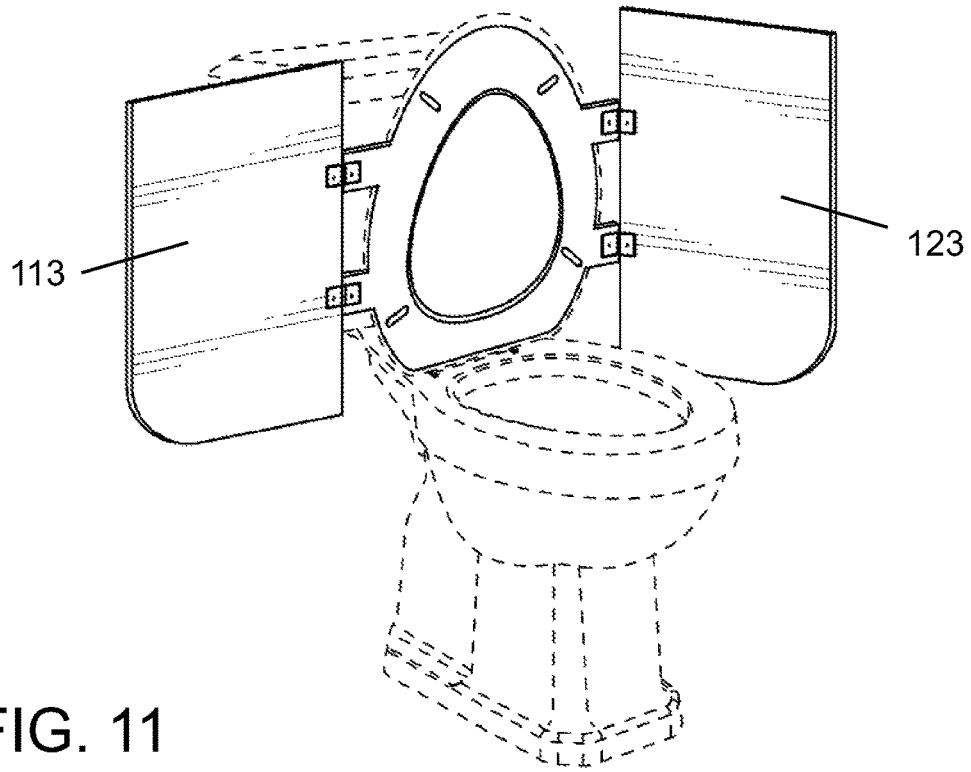
FIG. 11 shows an alternative embodiment of the toilet seat having a pivotable toilet splash guard panel.

In one embodiment as shown in FIGS. 8-9, the support arms may each be one continuous arm extending from a portion of its respective circumferential side edge. In another embodiment as shown in FIGS. 10-11, the first splash guard (110) may comprise two or more support arms (114) extending from the first circumferential side edge (28*a*), and to which the first panel (112) is mounted. The second splash guard (120) may also comprise two or more support arms (124) extending from the second circumferential side edge (28*b*), and to which the second panel (122) is mounted. Without wishing to limit the invention to a particular configuration, the splash guards may comprise any number of support arms provided that the support arms can sufficiently support the panels.

In preferred embodiments, the support arms are co-planar to the underside surface of the toilet seat. The support arms may also extend a sufficient distance away, e.g. about 2-4 inches, from the side edges of the toilet seat, thereby placing the panels at a distance from the edges so as to not obstruct the user or abut the toilet bowl, yet close enough to capture the splashing fluids. In other embodiments, the support arms may be constructed from the same material as the toilet, such as wood or plastic. In further embodiments, the support arms and the toilet seat may form a unitary piece.

In some embodiments, the first and second panels (112, 122) may be perpendicular to the underside surface (25) of the toilet seat. The panels may also be perpendicular to the support arms. In other embodiments, the panels may be continuously attached to the support arms that are also continuously attached to the toilet, thereby forming a unitary system.

In alternative embodiments, as shown in FIGS. 10-11, the first and second panels (112,122) may be pivotably connected to their respective support arms (114,124). For example, the panels may be connected to the support arms via hinges. In this embodiment, when the splash guards are in the upright position, the first and second panels (112,122) can be pivoted towards the toilet bowl rim (15) so as to position the panels closer to the rim for capturing the splashing fluids. The panels may also be pivoted outwardly and away from the rim so as to facilitate cleaning of the interior panel surface, and to provide unobstructed access to the toilet bowl during cleaning. Further still, the panels may be pivoted to a closed configuration such that panels and the toilet overlap each other and the entire system is flattened, thereby reducing the overall space required to store the system while in packaging or during non-use.

Consistent with previous embodiments, the first and second panels (112,122) may be flat and rectangular in shape, or alternatively triangular in shape. However, without wishing to be bound to a particular configuration, the panels may be according to any shape that would provide sufficient surface area to capture the splashing fluids. In further embodiments, the panels may have a textured surface or grooves capable of entrapping the splashed fluids and reducing fluid drip.

As shown in FIG. 10, in some embodiments, each of the first and second panels (112,122) may have a lip (150) disposed along at least two adjacent panel edges. For example, the lip may be disposed along the distal edge and the back edge of panels. Preferably, the lip is biased towards the interior surface (113, 123) such that when the first and second splash guards (110,120) are in the lowered or upright position, the lip (150) can capture the fluids that splash onto the interior surfaces (113, 123), thereby preventing said fluids from dripping onto the floor area. For instance, when the splash guards are in the upright position and the fluids are splashing onto the panels, the fluids would then drip in a downward direction due to gravity, and the lip disposed on the back edge of the panels would capture said dripping fluid. When the splash guards are in the lowered position, the fluids on the panel surface would again drip in the downward direction, and a second lip disposed on the distal edge of the panel would capture said dripping fluid.

As used herein, the term "about" refers to plus or minus 10% of the referenced number.

The disclosures of the following U.S. Patents are incorporated in their entirety by reference herein: US20090320198, U.S. Pat. Nos. 5,564,135, 5,815,851, 7,178,177, 7,412,732, 7,461,411, and 7,921,478.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A toilet splash guard system (100) for preventing splashing of fluids from a toilet bowl to a surrounding floor area, said system comprising:

a. a toilet seat (20) having a first circumferential side edge (28*a*) and an opposing second circumferential side edge (28*b*), b. a first splash guard (110) disposed on the first circumferential side edge (28*a*) of the toilet seat, wherein the first splash guard (110) comprises two or more support arms (114) extending from the first circumferential side edge (28*a*), and a first panel (112) angularly mounted to the two or more support arms (114) such that the first panel (112) projects away from an underside surface (25) of the toilet seat;

c. a second splash guard (120) disposed on the second circumferential side edge (28*b*) of the toilet seat, wherein the second splash guard (120) comprises at least one support arm (124) extending from the second circumferential side edge (28*b*) and a second panel (122) angularly mounted to the at least one support arm (124) such that the second panel (121) projects away from the underside surface (25) of the toilet seat;

wherein a proximal end (22) of the toilet seat is mounted to a toilet bowl rim (15) such that the toilet bowl (10) is disposed between the first splash guard (110) and the second splash guard (120), wherein when the toilet seat (20) is in a first position over the toilet bowl rim (15), the first and second splash guards (110,120) are in a lowered position such the support arms (114,124) are horizontally oriented relative to the floor area, wherein when the toilet seat (20) is rotated from the first position to a second position up and away from the toilet bowl rim (15), the first and second splash guards (110,120) rotate to an upright position such that the support arms (114,124) are vertically oriented relative to the floor area, wherein the first and second panels (112,122) extend forwardly and away from the underside surface (25) of the toilet seat, wherein during use of the toilet bowl (10) and the first and second splash guards (110,120) are in the upright position, the fluids splashing from the toilet bowl (10) are splashed onto an interior surface (113,123) of the first and second panels.

2. A toilet splash guard system (100) for preventing splashing of fluids from a toilet bowl to a surrounding floor area, said system comprising:

a. a toilet seat (20) having a first circumferential side edge (28*a*) and an opposing second circumferential side edge (28*b*), b. a first splash guard (110) disposed on the first circumferential side edge (28*a*) of the toilet seat, wherein the first splash guard (110) comprises at least one support arm (114) extending from the first circumferential side edge (28*a*) and a first panel (112) angularly mounted to the at least one support arm (114) such that the first panel (112) projects away from an underside surface (25) of the toilet seat;

c. a second splash guard (120) disposed on the second circumferential side edge (28*b*) of the toilet seat, wherein the second splash guard (120) comprises two or more support arms (124) extending from the second circumferential side edge (28*b*) and a second panel (122) angularly mounted to the two or more support arms (124) such that the second panel (121) projects away from the underside surface (25) of the toilet seat;

wherein a proximal end (22) of the toilet seat is mounted to a toilet bowl rim (15) such that the toilet bowl (10) is disposed between the first splash guard (110) and the second splash guard (120), wherein when the toilet seat (20) is in a first position over the toilet bowl rim (15), the first and second splash guards (110,120) are in a lowered position such the support arms (114,124) are horizontally oriented relative to the floor area, wherein when the toilet seat (20) is rotated from the first position to a second position up and away from the toilet bowl rim (15), the first and second splash guards (110,120) rotate to an upright position such that the support arms (114,124) are vertically oriented relative to the floor area, wherein the first and second panels (112,122) extend forwardly and away from the underside surface (25) of the toilet seat, wherein during use of the toilet bowl (10) and the first and second splash guards (110,120) are in the upright position, the fluids splashing from the toilet bowl (10) are splashed onto an interior surface (113,123) of the first and second panels.

3. A toilet splash guard system (100) for preventing splashing of fluids from a toilet bowl to a surrounding floor area, said system comprising:

a. a toilet seat (20) having a first circumferential side edge (28*a*) and an opposing second circumferential side edge (28*b*), b. a first splash guard (110) disposed on the first circumferential side edge (28*a*) of the toilet seat, wherein the first splash guard (110) comprises at least one support arm (114) extending from the first circumferential side edge (28*a*) and a first panel (112) angularly mounted to the at least one support arm (114) such that the first panel (112) projects away from an underside surface (25) of the toilet seat;

c. a second splash guard (120) disposed on the second circumferential side edge (28*b*) of the toilet seat, wherein the second splash guard (120) comprises at least one support arm (124) extending from the second circumferential side edge (28*b*) and a second panel (122) angularly mounted to the at least one support arm (124) such that the second panel (121) projects away from the underside surface (25) of the toilet seat;

wherein the first and second panels (112,122) are pivotably connected to their respective support arms (114,124), wherein a proximal end (22) of the toilet seat is mounted to a toilet bowl rim (15) such that the toilet bowl (10) is disposed between the first splash guard (110) and the second splash guard (120), wherein when the toilet seat (20) is in a first position over the toilet bowl rim (15), the first and second splash guards (110,120) are in a lowered position such the support arms (114,124) are horizontally oriented relative to the floor area, wherein when the toilet seat (20) is rotated from the first position to a second position up and away from the toilet bowl rim (15), the first and second splash guards (110,120) rotate to an upright position such that the support arms (114,124) are vertically oriented relative to the floor area, wherein the first and second panels (112,122) extend forwardly and away from the underside surface (25) of the toilet seat, wherein during use of the toilet bowl (10) and the first and second splash guards (110,120) are in the upright position, the fluids splashing from the toilet bowl (10) are splashed onto an interior surface (113,123) of the first and second panels.

* * * * *